United States Patent [19]

Phillips, Sr. et al.

[11] Patent Number: 4,843,647

[45] Date of Patent: Jul. 4, 1989

[54] COLD WEATHER SYSTEM

[75] Inventors: James G. Phillips, Sr., Albuquerque, N. Mex.; James G. Phillips, Jr., Pleasant Grove, Utah; Joanne Harlow, Utah; Gordon K. Scott, both of Orem, Utah

[73] Assignee: Burlington Industries, Inc., Greensboro, N.C.

[21] Appl. No.: 91,242

[22] Filed: Aug. 31, 1987

[51] Int. Cl.[4] ..... A41D 13/00; A41D 1/06; A41D 1/02

[52] U.S. Cl. ..... 2/69; 2/79; 2/93; 2/97; 2/115; 2/227

[58] Field of Search ..... 2/81, 79, 69, DIG. 1, 2/93, 97, 115, 227, 272

[56] References Cited

U.S. PATENT DOCUMENTS

| | | | |
|---|---|---|---|
| 2,976,539 | 3/1961 | Brown, Jr. | 2/93 X |
| 3,045,243 | 7/1962 | Lash et al. | 2/DIG. 1 |
| 4,034,417 | 7/1977 | Ellis | 2/81 |
| 4,185,327 | 1/1980 | Markve | 2/79 X |
| 4,320,538 | 3/1982 | Saft | 2/93 X |
| 4,507,806 | 4/1985 | Coombs | 2/97 X |
| 4,513,451 | 4/1985 | Brown | 2/69 |
| 4,561,121 | 12/1985 | Ehring et al. | 2/227 X |
| 4,569,874 | 2/1986 | Kuznetz | 2/272 X |
| 4,608,715 | 9/1986 | Miller et al. | 2/93 |
| 4,685,155 | 8/1987 | Fingerhut et al. | 2/81 X |
| 4,739,522 | 4/1988 | Lassiter et al. | 2/69 |

FOREIGN PATENT DOCUMENTS 2476988 4/1981 France .

OTHER PUBLICATIONS

"Cozy Quip", brochure, 1975.

Field Book, Boy Scouts of America, 1984, pp. 77, 78, 343 through 347.

"Synergy Works", Advertisement, 1978, pp. 1, 4, 5, 7, 8, 10 and 11.

"Without Fire or Shelter", by J. T. Phillips, 1984, introductory pages and pages with cold weather clothing and sleeping bag construction.

*Primary Examiner*—H. Hampton Hunter

*Attorney, Agent, or Firm*—Nixon & Vanderhye

[57] ABSTRACT

A cold weather system for keeping a wearer comfortable in a temperature of about −60° F.-+40° F. and winds up to 100 miles per hour, utilizes a shirt, pants, parka and wind shirt and wind pants. A sleeping bag and moisture handling pad/deicing cloth are compressed in compressor bags and easily transported by the wearer for comfort during sleeping too, and used with a bivvy sack having a tent flap. The shirt and pants are ventable so that they provide comfort over a wide temperature range, the vents being completely closed when maximum thermal protection is desired. The parka includes a windskirt which engages the wearer's legs. The wind garments are made of fine denier 100% synthetic material tightly woven so that they have very low air porosity. The parka and wind shirt can be connected together to provide an emergency bivac sleeping bag. The shirt, pants, and parka include an inner fabric of 100% synthetic material, an inner layer of foam at least ⅛ inch thick, and up to about one inch thick, and an outer shell of low porosity, but high moisture vapor transmission, material. Portions of the shirt and pants that will be vented also include a fabric covering the insulation, the insulation covering fabric having very high air porosity.

19 Claims, 5 Drawing Sheets

Fig. 1
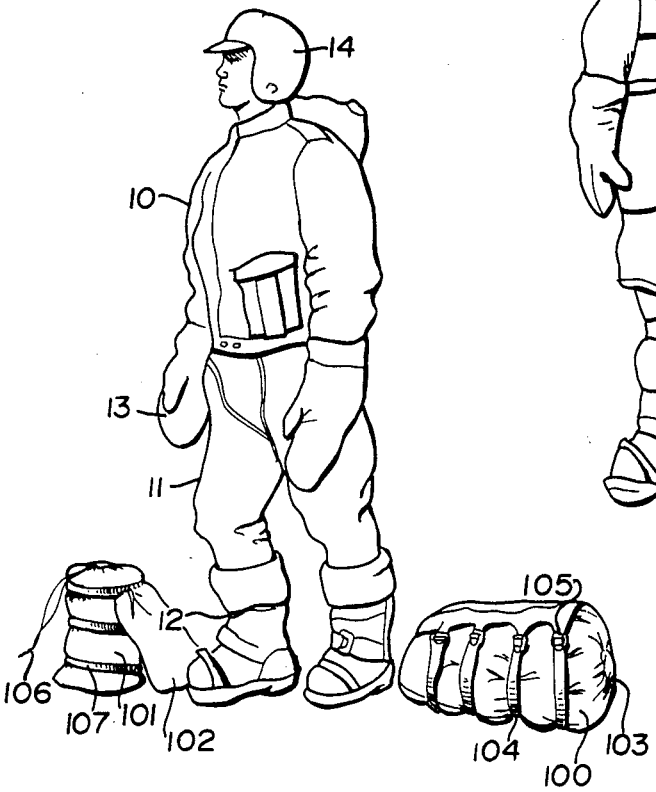
Fig. 2
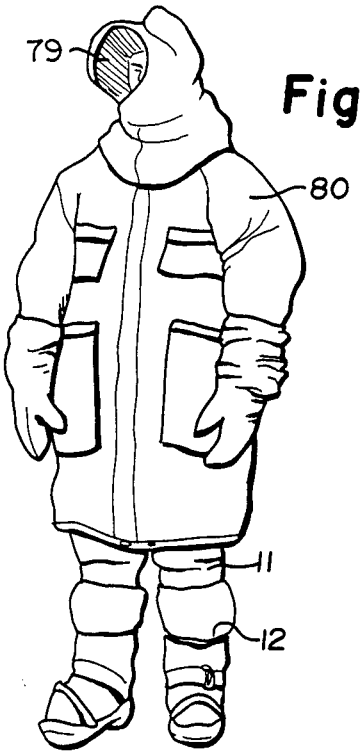
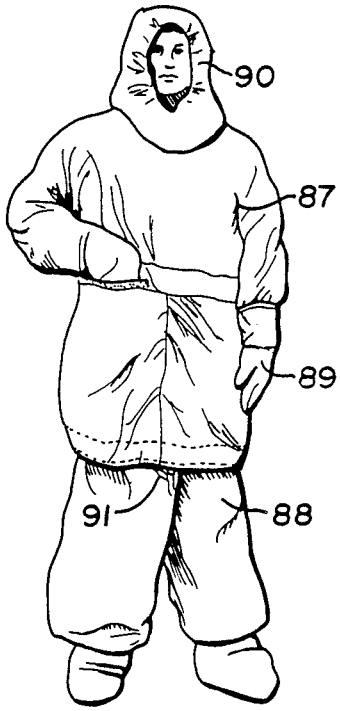
Fig. 3

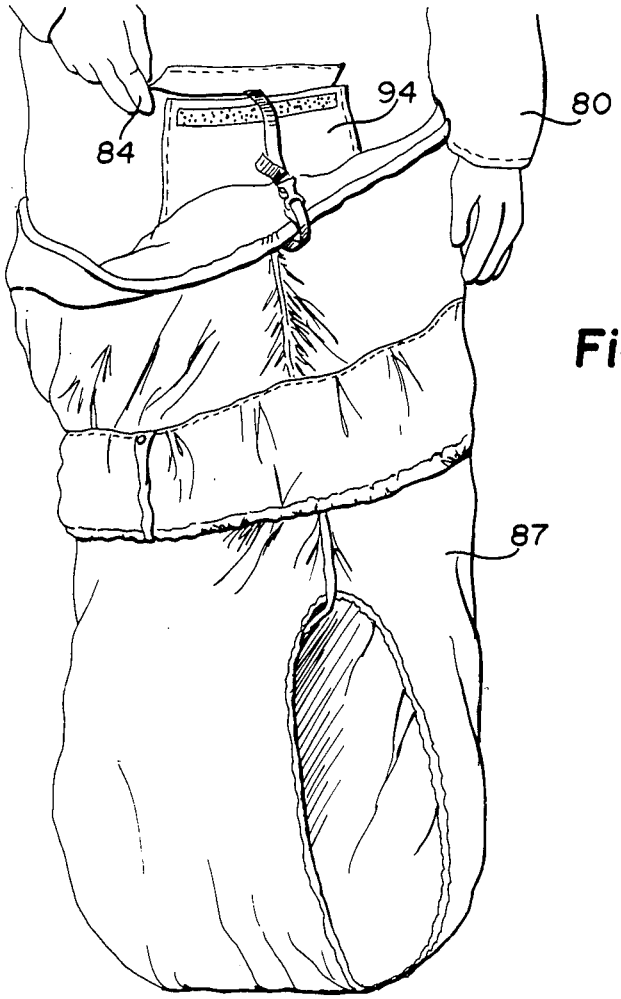
Fig. 13
Fig. 14
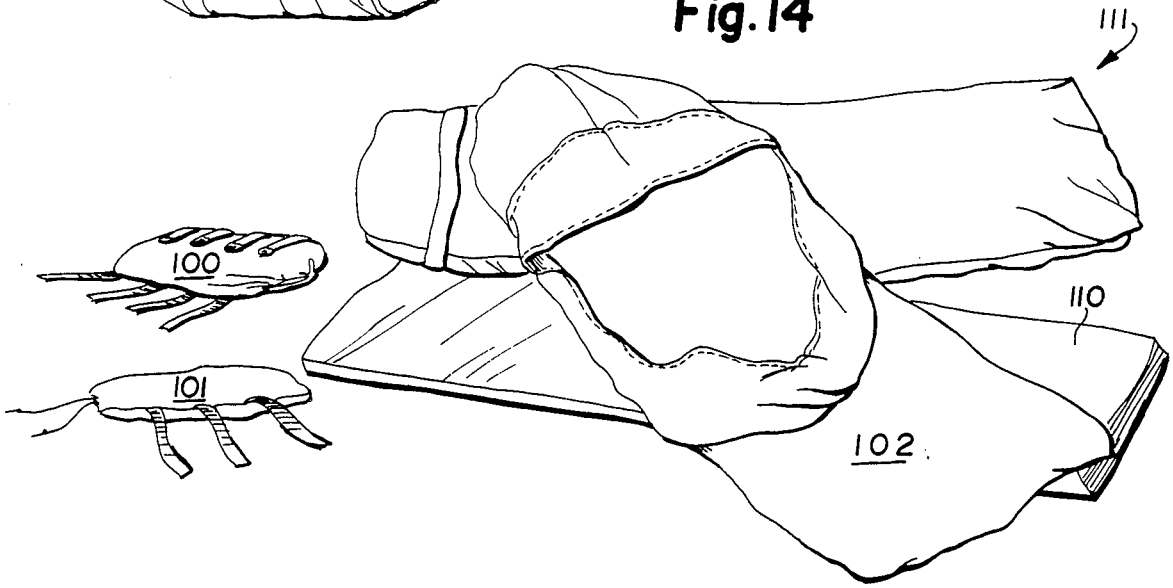
Fig. 15
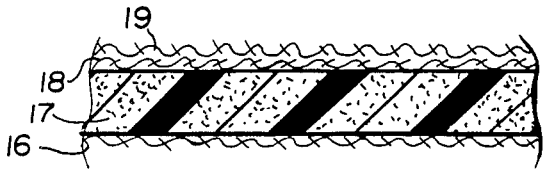

COLD WEATHER SYSTEM

BACKGROUND AND SUMMARY OF THE INVENTION

The invention relates to a system for keeping a human warm and comfortable even under the coldest and highest wind conditions that might be encountered in cold weather climates around the world. The system is designed for maintaining the comfort for a human, both while awake and active and when asleep, in temperatures from −60° F. to +40° F., and in winds up to 100 miles per hour. This system achieves this goal with a minimum number of component parts, each component part having a number of features to make it flexible to adapt to various temperature and/or wind conditions, or being readily stored or deployed for adjusting the system depending upon the weather conditions.

The, footwear, hand garments, hats, and face tunnel components that may be utilized in the system according to the present invention have been described in detail in other, co-pending applications. For example, the hand protection/mittens, including wind mitts, may be seen in co-pending application Ser. No. 58,891, filed June 5, 1987, and a variation thereof is disclosed in co-pending application Ser. No. 918,920, filed Oct. 15, 1986. The cold weather footwear is disclosed in co-pending application Ser. No. 24,558, filed Mar. 11, 1987. The cold weather hat is shown in application Ser. No. 76,011, filed July 21, 1987, and the face tunnel is shown in application Ser. No. 52,989, filed May 22, 1987. Additionally, the sleeping bag has been described in detail in a prior, co-pending application Ser. No. 12,954, filed Feb. 10, 1987. The present application primarily relates to the components for protecting the torso and legs of the wearer, as well as accessory components associated with the sleeping bag.

According to the present invention, the main everyday components comprise a shirt and pants. The shirt and pants typically provide protection in the temperature range of −20 F.-+40° F. at low to moderate activity levels, and with low winds. Separate wind garments, primarily a wind shirt and wind pants, are also provided. The wind garments are worn over the other clothing, and in fact are outside the thermal shell defined by the other clothing. The wind garments effectively extend the lower range of temperature of the garments with which they are utilized about 10° F. in still air, and lower the wind chill factor 50°-60°. The wind garments may be readily stored and deployed, are lightweight, and may readily be transported by the wearer. A cold weather parka also is provided. The parka has a windskirt which prevents excessive cooling as a result of wind blowing underneath the garment. The parka is designed to be worn over the shirt and pants, and the wind garments may be worn over the parka too. The parka lowers the comfortable temperature range by about 25° F. The parka is also adapted to cooperate with the wind shirt to provide an emergency sleeping bag.

The invention utilizes a cold weather shirt and a cold weather pair of pants that have thermally insulating high air porosity inner portions, and a low air porosity outer portion. Means are provided for connecting the inner and outer portions together so that the outer portion can be moved from a first position in which it selectively covers substantially the entire inner portion to provide maximum warmth and wind resistance, to a second position in which it exposes a portion of the inner portion to atmospheric air to thereby reduce the warmth and wind resistance provided by the shirt and pants. This is what allows the shirt and pants to function to keep the wearer comfortable in the entire temperature range of −20° F.-+40° F. The shirt also includes snap fasteners or the like that allows the lapel and related portions to be snapped back to provide for additional venting.

The inner portions of the everyday shirt and pants are preferably of three layers, an inner fabric layer of synthetic material, an open cell foam layer which will typically have a thickness of greater than $\frac{1}{4}$ inch, but may be less depending upon the particular foam characteristics and surface manifestations, and an outer highly porous fabric portion. The outer shell fabric comprises a fabric which has excellent wind resistance while still having good moisture vapor transmission characteristics. Such an outer shell fabric is shown in co-pending application Ser. No. 885,444, filed July 14, 1986, and typically would have an air permeability of less than 15 cubic feet/min./ft.$^2$ at 0.5 inches head of water (and sometimes less than 10), and a moisture vapor transmission of at least 1,000 grams/m.$^2$/24 hr. The entire garments when utilized together would have a vapor transmission of at least 500 grams/m.$^2$/24 hr.

Typical fabrics for the outer, shell fabric of the garments, include VERSATECH, and tightly woven polyamide yarn fabrics having a warp count of between about 63–79 (e.g. 79) and a filling yarn count of between about 56–61, e.g. such as shown in said application Ser. No. 885,444. The foam portions of the garments, and related components, may also assume the configuration such as shown in co-pending application Ser. No. 879,053, filed June 26, 1986, Ser. No. 31,661, filed Mar. 30, 1987, or Ser. No. 15,981, filed Feb. 18, 1987. The cold weather parka typically has the same basic constructural components as the shirt and pants but includes a windskirt at the bottom thereof, and the parka extends downwardly to approximately the wearer's knees.

The accessory components associated with the sleeping bag comprise a moisture handling pad/deicing cloth, a bivvy sack, and compressor bags, one each for the sleeping bag and the moisture handling pad. The moisture handling pad/deicing pad is designed to be disposed beneath the sleeping bag. The moisture handling pad conducts moisture that migrates from the bottom of the sleeping bag. It moves the moisture into the deicing cloth directly below the moisture handling pad. The moisture collects in the deicing cloth and freezes on it within the deicing cloth fabric. The frozen moisture can then be physically removed. This arrangement prevents buildup of moisture and ice in the sleeping bag itself even over extended use in extreme cold. The bivvy sack is disposed beneath the moisture handling pad, and encircles the moisture handling pad and the sleeping bag to provide additional wind and rain protection, camouflaging in snow, and an optional minitent to provide additional room at the head area while protecting it. The compressor bags function to compress the sleeping bag and moisture handling pad to manageable sizes so that they may be readily transported.

It is the primary object of the present invention to provide a cold weather system that allows comfort for the wearer, both when active or asleep, over an extraordinarily wide temperature range of about −60° F.−+40° F., and with winds for 0 to 100 miles per hour, yet includes a minimum number of components. This and other objects of the invention will become clear from an inspection of the detailed description of the invention and from the appended claims.

BRIEF DESCRIPTION OF THE DRAWINGS

FIG. 1 is a perspective view illustrating a wearer with the everday components of the system according to the invention, with sleeping bag and moisture handling pad shown in their compressor bags, and bivvy sack in its storage sack;

FIG. 2 is a perspective view of a wearer utilizing the cold weather parka and face tunnel with the garments of FIG. 1;

FIG. 3 is a perspective view showing a wearer with wind garments over the everday garments of FIG. 1;

FIG. 13 is a front perspective view showing the utilization of the wind shirt with the parka as an emergency sleeping bag;

FIG. 14 is a top perspective view of the moisture handling pad, bivvy sack, and sleeping bag laid out, and the compressor bags collapsed; and FIG. 15 is a cross-sectional schematic view of the contruction of a number of the component garments of the system according to the invention.

DETAILED DESCRIPTION OF THE DRAWINGS

Figure 4:
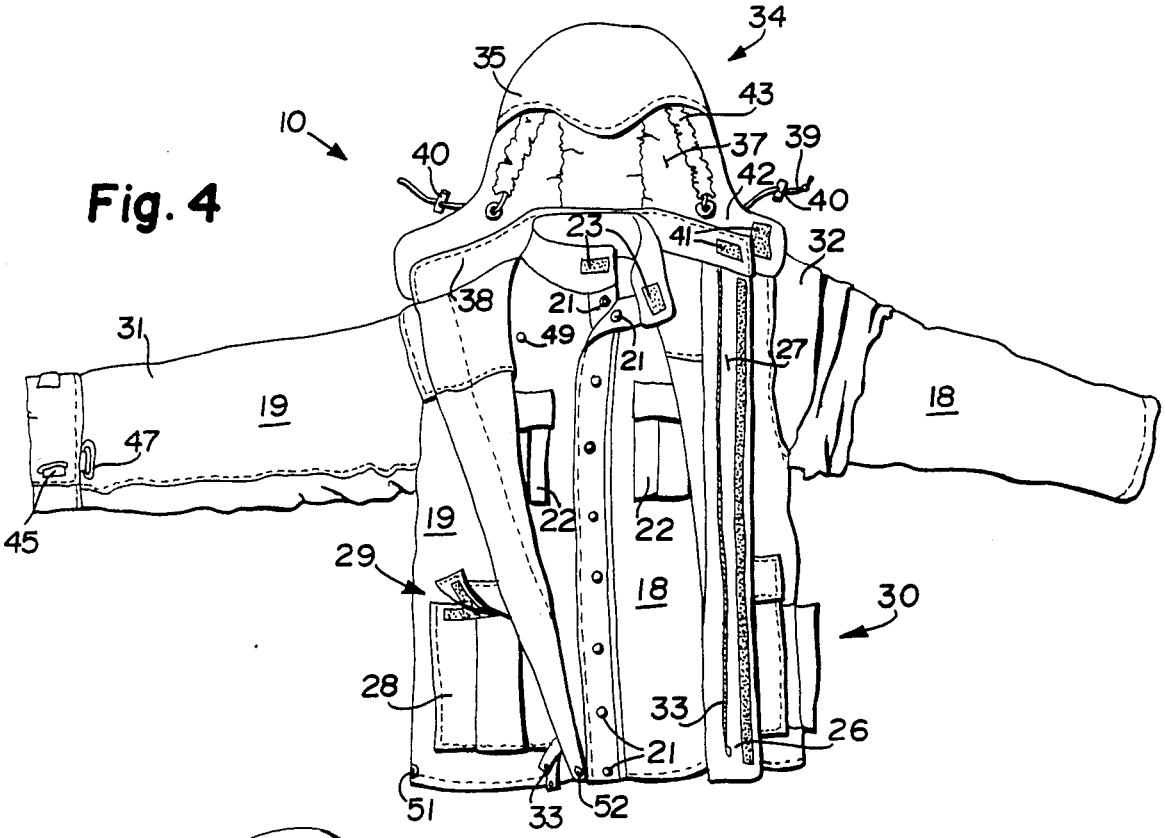
FIG. 4 is a front view showing the details of the shirt of FIG. 1.

FIG. 1 illustrates utilization of the everyday components of the cold weather system according to the invention. The major components of the system include the shirt 10, pants 11, footwear 12, mittens 13, and hat 14. The mittens, footwear, and hat 13, 12, 14, respectively, are described fully in the co-pending applications identified above (the disclosures of which are incorporated by reference herein), and will not be further described herein.

The shirt 10 is seen most clearly in FIGS. 4 through 7. It provides a cold weather protection over a temperature range of about −20° F. to +40° F.

With particular reference to FIG. 15, the construction of the shirt includes a lining fabric 16, a layer of insulating foam 17, an insulation covering fabric 18, and a shell fabric 19. All components of the system must be made of synthetic material in order to have the appropriate moisture handling properties. The wearer must be sure to wear only 100% synthetic (e.g. polyester or nylon) undergarments (if any). The lining 16 may be constructed from a wide variety of materials, and a wide variety of techniques. One preferred form is 100% nylon tricot jersey.

The foam layer 17 preferably comprises a polyurethane foam, which may be skinned, and may have a widely varying thickness. Typical thicknesses are from $\frac{1}{8}$ inch–one inch. When convoluted foam, or specialty types of foam, are utilized, the thickness may be decreased, and minimized.

Outside of the foam 17 an insulation covering fabric 18 is provided. The insulation covering fabric 18 is desirable primarily in those areas that will be exposed when the garment is vented. The layer 18 is unnecessary for areas of the garment (if any) that are not vented. The fabric 18, too, may be produced from a wide variety of materials, and from a wide variety of techniques. One particularly suitable fabric 18 is very porous 100% polyester warp knit mesh.

The outermost fabric 19, the shell fabric, preferably is of a wind resistant construction. Exemplary wind resistant constructions are illustrated and described in the co-pending applications identified above, the disclosures of which are hereby incorporated by reference herein, i.e. have fine denier synthetic yarns with tightly woven construction. Typically the shell 19 could be VERSATECH, or tightly woven nylon.

The various layers 16 through 19 of the shirt 10 are held together by stitching, and at areas where stitching is provided 100% polyester knit rib trim may be utilized.

The components 16 through 18 have high air permeability, while the component 19 has low air permeability. The connection of the shell 19 to the rest of the components is in such a manner that a wide variety of different degrees of venting may be provided. The cold weather shirt 10 and cold weather pair of pants 11 each thus have a thermally insulating high air porosity inner portion, and a low air porosity outer portion. The inner and outer portions are connected together (as by stitching only at selected areas) so that the outer portion can be moved from a first position in which it selectively covers substantially the entire inner portion to provide maximum warmth and wind resistance, to a second position in which it exposes a portion of the inner portion to atmospheric air to thereby reduce the warmth and wind resistance provided by the shirt or pants.

Specifically, for the shirt 10 according to the invention, as illustrated in FIGS. 4 through 7, note that the outer portion of the shirt is provided by the outermost shell 19, while the shell may be "peeled back" to vent the wearer's body area, exposing the air permeable layer 18 and underlying materials. The arms, too, are formed by an outer covering 19 that is wind resistant, which may be pushed back (compare the left and right arms in FIG. 4) to expose the air permeable layer 18.

The jacket 10 comprises an open front which is closed by fasteners, such as plastic snap fasteners 21. Pockets 22 are provided on the layer 18. The collar of the inner thermal insulating, high porosity portion of the shirt is closable with closures 23, such as hook and loop fasteners. The outer shell 19, of low porosity material, is closable utilizing cooperating closure components 26, provided on flaps, such as flap 27, to seal the inner components from the outside air when the outer shell 19 is closed. The components 26 preferably comprise hook and pile fasteners. Note that stitching 24 (see FIG. 7) is provided at the top of the components to hold them together around the top back neck area thereof.

Figure 5:
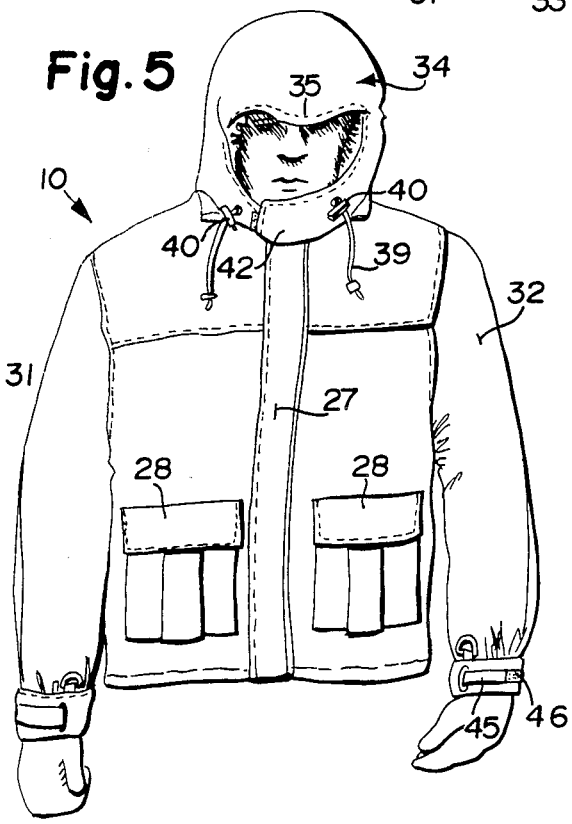
FIG. 5 is a front view of the shirt of FIG. 4, on a wearer, with no venting so that maximum warmth is provided.
Figure 7:
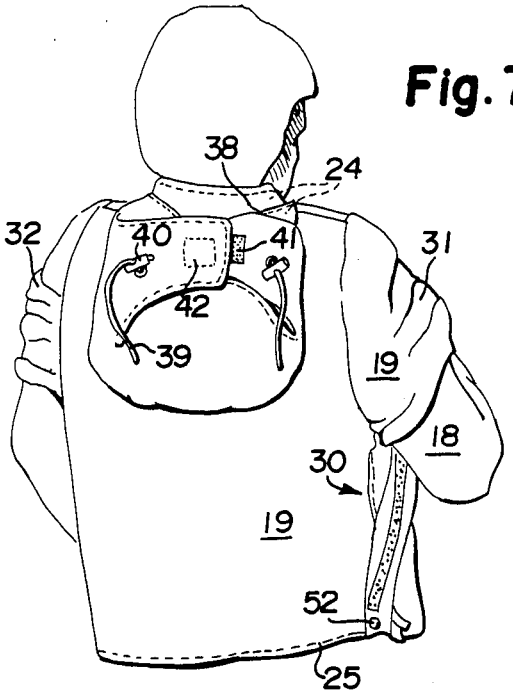
FIG. 7 is a rear perspective view of the shirt of FIG. 4 in maximum venting position.

The inner and outer components are also connected together at the bottom 25 thereof (see FIG. 7). FIGS. 4 and 5 illustrate storage pockets 28 which are provided on the outer shell 19, with closure means 29 (such as cooperating hook and pile fasteners) therefor. Hand warmer pockets, such as the pocket 30 illustrated in FIG. 4, may also be provided.

The outer shell includes sleeve portions 31, 32, which can be moved to cover or expose (compare the left and right arms in FIG. 4) the inner shell 18 at the wearer's arms.

In addition to the wind seals 26 provided on flaps 27, the front of the outer shell 19 is closed utilizing zipper 33 (see FIG. 4), or like fasteners.

Attached to the outer shell 19, and at the back of the garment to both the inner and outer shells, is the hood 34 having rain bill portion 35. The interior cloth layer 37 forming the hood preferably is of VERSATECH, and the hood 34 otherwise has a three part construction including an inner foam layer and outer layer, also of VERSATECH or tightly woven nylon, generally as illustrated in FIG. 15. The hood can be tightly closed around the wearer's face utilizing draw cord 39 with external cord locks 40, the draw cord extending through a head seal 43 which is adapted to go around the wearer's face. The cord locks 40 are mounted so that they are away from the face of the wearer, as can be seen most clearly in FIG. 5. Stitching 38 (FIGS. 4 and 7) is provided connecting the hood 34 to the back portions of the garment 10.

The chin portion of the hood 34 is sealed when the garment is not vented by fasteners 41 mounted on cooperating flaps 42. The fasteners 41 preferably are cooperating hook and loop fasteners, as illustrated in FIGS. 4 and 7.

Other components for facilitating venting or tight wind resistant protection for the shirt 10 include the sleeve closures 45 which have fastener portions 46 (see FIG. 5) thereof. The sleeve closures 45 are straps that may be manipulated with one hand, and tightened to tighten the bottom of the sleeve at the wrist. The straps 45 are held in the tightened position, as illustrated in FIG. 5, by attaching them to the fastener portions 46. Preferably the strap 45 includes cooperating hook and loop fastener portions, one on the inside of the free end of strap 45, and the other on the portion 46. Note that on the sleeves 31, 32, a D ring 47 is provided, for facilitating attachments of mittens.

Figure 6:
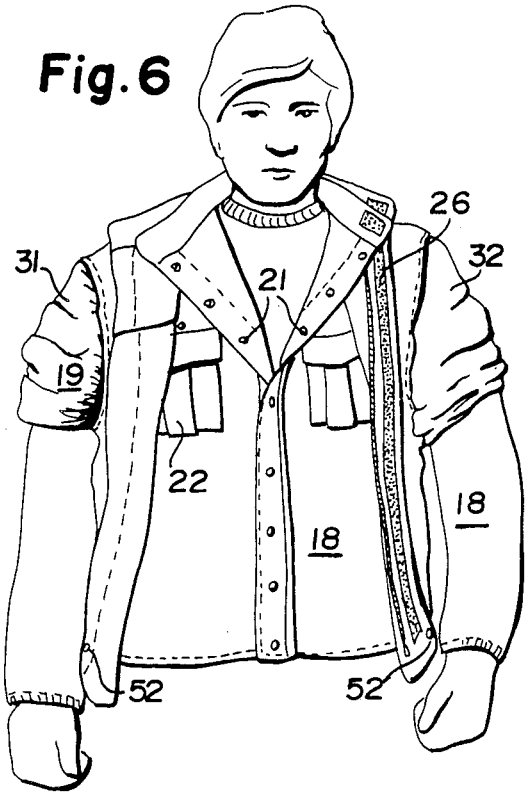
FIG. 6 is a front view of the shirt of FIG. 4, on a wearer, with maximum venting.

In order to facilitate venting, snaps, such as snap 49 in FIG. 4, can be provided on the inner shell to which the lapel snap portions 21 may be snapped. This maximum venting position is illustrated in FIG. 6 and FIG. 7. Note also that maximum venting is facilitated by the cooperation between fasteners 51 (see FIG. 4) and 52 (see FIGS. 4, 6, and 7).

Using the shirt 10, the wearer can go from a maximum vented position as illustrated in FIGS. 6 and 7 on warm days, to an intermediate position as illustrated in FIG. 4, to a maximum warmth position as illustrated in FIG. 5.

Figure 8:
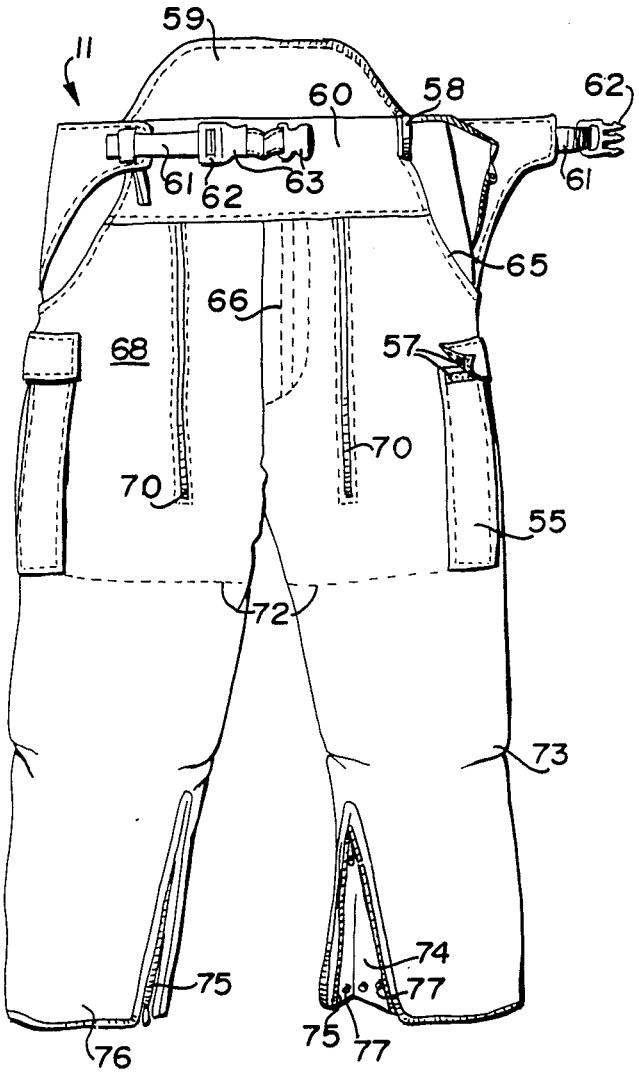
FIG. 8 is a front view of the pants of FIG. 1.
Figure 9:
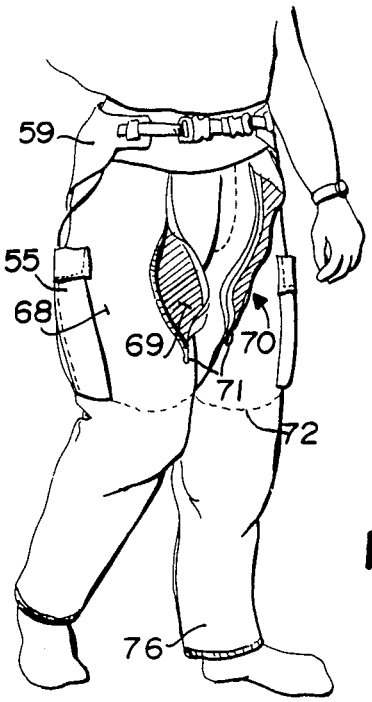
FIG. 9 is a front perspective view of the pants of FIG. 8 on a wearer, with full venting.
Figure 10:
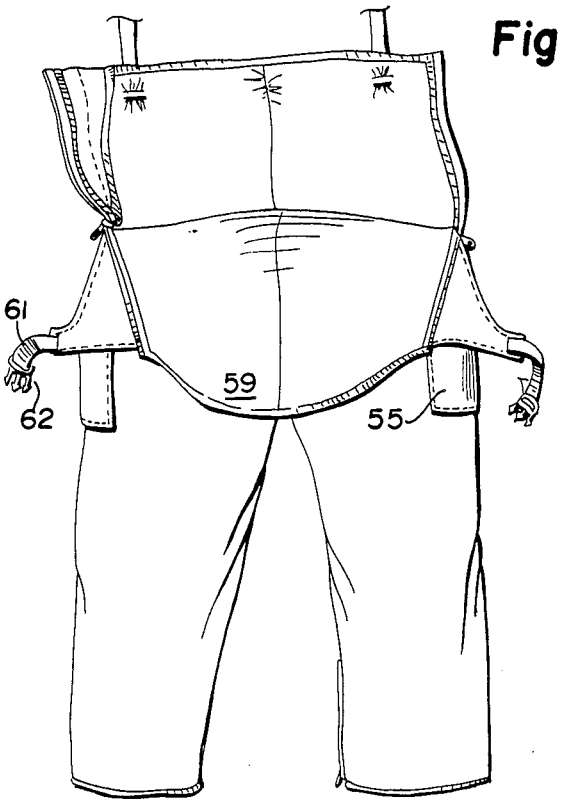
FIG. 10 is a rear view of the pants of FIG. 8 illustrating the rear drop seat in dropped condition.

FIGS. 8 through 10 illustrate cold weather pants 11 according to the present invention. The pants 11, like the shirt 10, have maximum venting or maximum warmth provided positions, the maximum venting position illustrated in FIG. 9 and the maximum warmth portion in FIG. 8. The pants include an inner and outer component construction, just like the shirt 10, with the outer shell fabric being wind resistant and the inner face fabric covering the foam 17 or the like being air permeable. The inner and outer components are connected together only at spaced locations so that air may be selectively allowed between the inner and outer components.

The pants 11 includes large side leg cargo pockets 55 with weather proof flaps 56 which are closed by sealing closures such as hook and pile fasteners 57. At the waist portion of the pants 11, suspender loops 58 are provided as well as a back bib 59. A waistband portion 60 is provided opposite the bib 59. The bib 59 includes side portions connected to straps 61 having fasteners 62 at the ends thereof, the fasteners cooperating with fastener receiving clasps 63 mounted on the waistband portion 60. The adjustable quick side release buckles 62 and cooperating clasps 63 are preferably made of plastic, or a like thermally insulating material. The components 62, 63 may be those such as shown in U.S. Pat. No. 4,150,464, and sold by FASTEX of Des Plaines, Ill. FIG. 9 shows the pants with the bib attached in front, while FIG. 10 illustrates the buckle 62 detached from the clasps 63 so that the bib 59 is dropped to allow the wearer to perform normal bodily functions.

The pants 11 also comprise side pockets 65 that allows the wearer to insert his hands in exterior compartments. The pockets 65 are provided by extra flaps of the outer fabric 19, the lining of each pocket 65 including the fabric 19 over the inner fabric 18.

The pants are also closed in front by a fly area 66 which includes an air seal fastener system (such as hook and pile strips) while a zipper is provided in the inner shell (not shown), again for allowing normal bodily functions. Also, side gussets 67, seen most clearly in FIG. 8, are provided, which are closed by plastic zippers 67' (see FIG. 10). Of course suspenders, shown schematically at the front in FIG. 10, may be connected to the suspender loops 58 to also hold the pants in place.

Vent means are provided in the outer component to allow air to flow into contact with the inner component at the thigh, crotch, and buttocks portions of the pants. Such vent means are preferably provided by the outer covering component 68, and the inner component 69 at the thigh area with a plurality of generally vertically disposed slits 70 formed in the portion 68 above the portion 69, on opposite sides of the crotch. The vents 70 extend from just below the bottom of the crotch portion of the pants (e.g. 4 inches below) to approximately the waist area of the pants as illustrated in FIGS. 8 and 9. The slits 70 are closed by fasteners, such as plastic zippers 71 (see FIG. 9). The vents 70 are located where they are since the normal walking or running movement of the wearer will cause a type of pumping action which will pump ambient air into the area between the components 68, 69, ventilating the entire thigh, crotch, and buttocks area of the wearer in the maximum venting position illustrated in FIG. 9.

Stitching means 72 are provided for attaching the outer component portion 68 to the inner component 69 along the entire peripheries thereof at a point just below (e.g. 3 inches below) the bottom termination of the vent slits 70. The stitching means 72 are provided in order to prevent snow, or other material, which may enter vent slits 70 from passing completely down the legs of the pants.

The pants 11 further comprise leg portions 73 and of course leg openings at the bottom thereof. In an alternative embodiment, the leg openings include gussets 74 which may be accessed by zippers 75, and plastic snaps 77 for tightening up the pants adjacent the bottoms 76 of the legs (which bottoms 76 define the leg openings). This construction utilizing the gussets 74, snaps 77, and zippers 75 allows the pant legs 73 to be tightened at the portions 76 to facilitate insertion of the wearer's legs into footwear 12, which overlies the pants 11 at the portions 76 (see FIG. 1).

Figure 11:
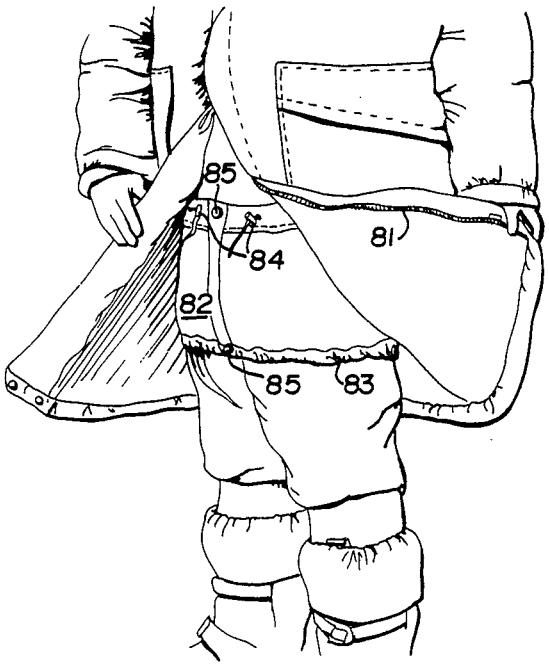
FIG. 11 is a front perspective view of a portion of the system of FIG. 2, showing the windskirt of the parka.

FIGS. 2 and 11, illustrate a cold weather parka 80 which may be used in especially cold weather conditions. A wind tunnel 79 can be utilized with the parka 80. A wind tunnel 79 is shown in co-pending application Ser. No. 52,989, filed May 22, 1987. The parka has a three layer construction with the inner lining fabric, foam (about ⅛–1" thick), and outer wind resistant fabric, as illustrated in FIG. 15 (without the layer 18), and attached hood with chin cover essentially the same as for the shirt 10. Parka 80 also includes a depending bottom portion which terminates with stitching and a ridge at the bottom 80', the bottom 80' being disposed generally at the wearer's knee level. Double acting zipper 81 (see FIG. 11) is the main closure for the front of the parka, but a wind seal with Velcro closures is also provided just like for the shirt 10.

At the inner bottom of the parka 80, as illustrated in FIG. 11, there is a windskirt portion 82 formed of wind resistant material, such as VERSATECH, or fine denier closely woven nylon fabric, such as nylon woven fabric having a warp count between about 63–79 (e.g. 79) and a filling yarn count of between about 56–61 and having an air permeability of less than 15 cubic feet/min./ft.$^2$ at 0.5 inches of water, and a moisture vapor transmission of at least 500 grams/m.$^2$/24 hr., and preferably at least 1,000. At the bottom of the windskirt 82 is provided an elastic band sewn within a hem, as illustrated at 83. The top of the windskirt is tightened by a draw cord 84' having cord locks 84 for locking it into any position into which it has been tightened. The front of the windskirt is closed up so as to tighten up the elastic hemmed band 83 around the legs by snap fasteners 85.

The shirt 10 and pants 11, with cooperating head gear, hand gear, and footwear, provide cold weather protection between the temperatures of about −35° F. and +20° F. Parka 80 cooperates with the shirt and pants for extending the effective range of comfort when the worn with such shirt and pants about 25° F. (e.g. down to about −60° F. in still air). However in cold weather environments there often are excessive winds which, even despite the wind resistance provided by the outer shell 19 of the clothing system according to the invention, result in some extra and undesirable heat loss from the wearer. Therefore according to the invention wind protecting garments are also provided. The wind protecting garments include (see FIG. 3) a wind shirt 87, wind pants 88, and wind mitts 89. The shirt 87 preferably includes an integral hood 90.

The wind protecting garments 87 through 89 are made of 100% fine denier polyester, or nylon, fabric such as VERSATECH. They have low air porosity but high moisture transport capabilities, as described for the shell fabrics in co-pending application Ser. No. 885,444, filed July 14, 1986; i.e. an air permeability of less than about 15 cubic feet/min./ft.$^2$ at 0.5 inches head of water, and a moisture vapor transmission rate of at least about 500 grams/m.$^2$/24 hr., preferably at least about 1,000. They are dimensioned to fit over the shirt and pants, or over the shirt, pants, and parka, and may be held in place by elastic, snap fasteners, draw cords, or any other conventional means. Typically there is no front closure associated therewith, and elastic is provided at the sleeves and at the bottom of the pant legs. The wind protecting garments increase the effective comfort range of the other garments, when utilized therewith, about 10° F.–20° F. in still air, and by lowering the effective comfort wind chill factor by about 50° F. Utilizing the wind garments over the parka, the cold weather garment system according to the invention is capable of keeping the wearer comfortable from the thermal standpoint at temperatures as low as −60° F. in winds up to 100 miles per hour.

The wind garments typically would be of low weight. For example the wind shirt 87 would typically weigh about 1.3 pounds, and the wind pants 88 about 0.5 pounds, with the wind mitts 89 less. The wind mitts 89 are more fully disclosed in co-pending application Ser. No. 58,891, filed June 5, 1987.

Figure 12:
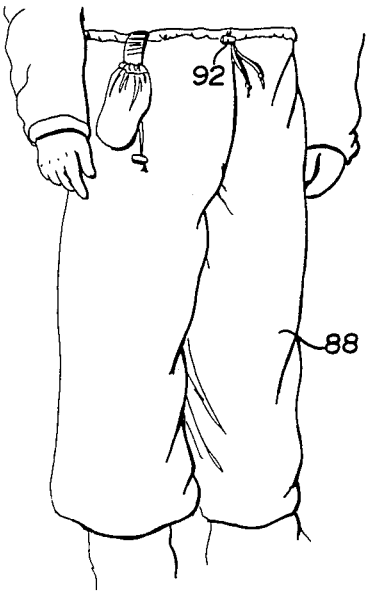
FIG. 12 is a front detail perspective view showing the wind pants of the system of FIG. 3 in more detail.
Figure 7:
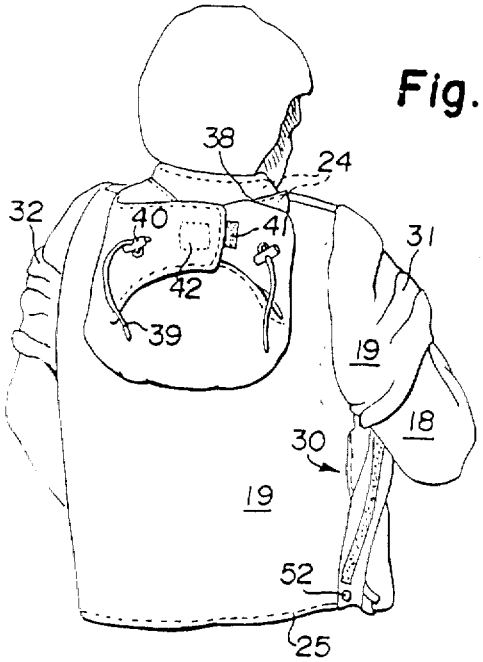
Figure 8:
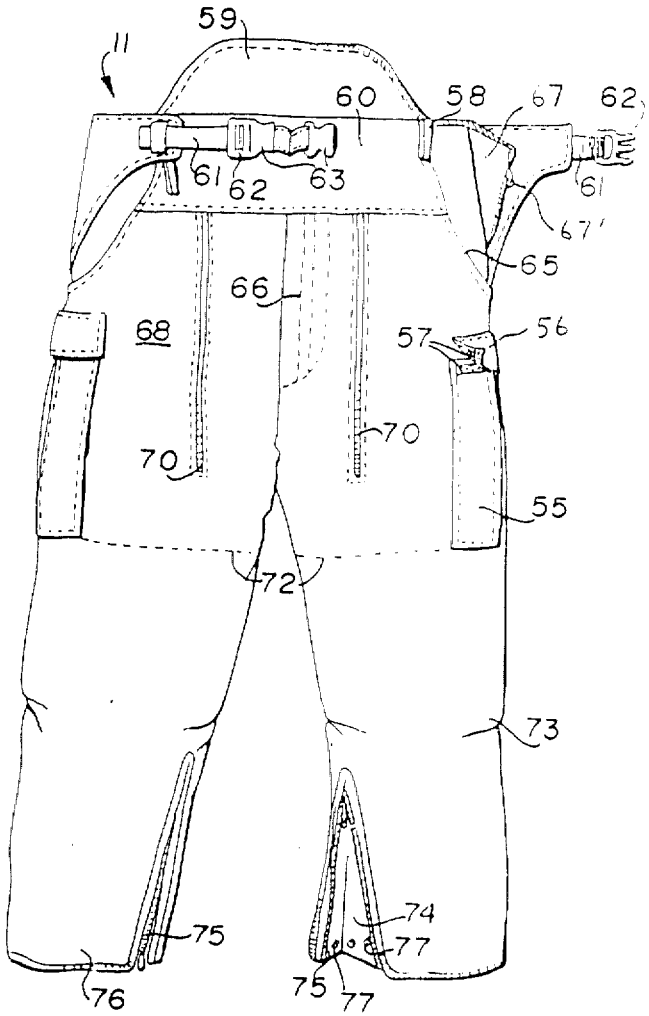
Figure 9:
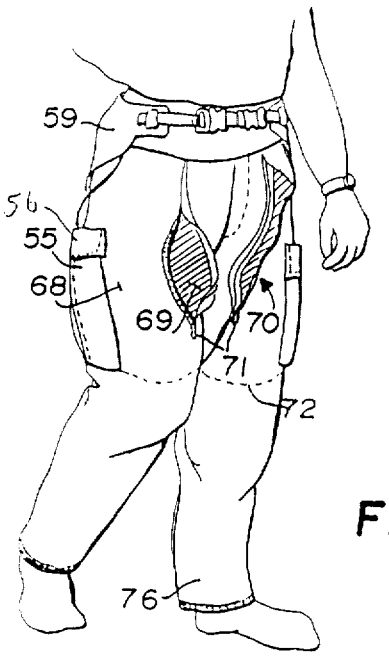

FIG. 3 illustrates an elastic bottom portion 91 disposed within a hem and closable by snap fasteners 91' at the bottom of the wind shirt 87 for tightening at the bottom. FIG. 12 illustrates a draw cord 92 at the top of the wind pants for tightening it. Both the wind shirt and wind pants are preferably stored for easy transportation in their own self-contained pouch, made of the same material as the wind garments themselves. Such a pouch 93 connected by a strap 94 to the wind pants 88 itself, and closable by a draw cord 95, is illustrated in FIG. 12. A similar pouch is provided connected to the wind shirt 87.

In order to enhance the flexibility of the system, the wind shirt and parka can cooperate together to form an emergency sleeping bag. The manner in which this is done is illustrated in FIG. 13. First, the wind shirt 87 is turned inside out, the draw cord 90' for the hood 90 is pulled tight, and the sleeves are kept on the inside, as illustrated schematically at 96 in FIG. 13. Connected to the inside of the wind shirt 87, and normally extending outwardly therefrom, is a skirt portion 97. A pair of straps 98 having clasps 98*a* at the ends thereof are connected to the skirt 97. These straps 98 and clasps 98*a* cooperate with straps 99 which are attached to, and stored within, pockets 99*a* of the parka 80, the straps 99 having buckles 99*b* attached thereto. The clasps and buckles 98*a*, 99*b* may be of the type such as shown in U.S. Pat. No. 4,150,464, and sold by Fastex in Des Plaines, Ill.

In using the parka 80 and wind shirt 87 as an emergency bivac sleeping bag, the user forms the wind shirt 87 essentially into a bag with an open top by tucking in the sleeves 96, and pulling the draw string 90' (see FIG. 3) at the neck opening at the hood 90 tight to essentially completely close up the neck opening. Then the wearer steps into the bag through the open top thereof (FIG. 13) and fastens the fasteners 98*a*, 99*b* on the straps 98, 99 to hold the wind shirt and parka in a position in which an emergency bivac sleeping bag is provided.

The invention also contemplates a sleeping system, the components of which are illustrated in FIGS. 1 and 14, and include accessory components for facilitating comfort for the user when he is sleeping. These accessory components include a sleeping bag and a moisture handling pad both in compressor bags, and a bivvy sack which is disposed within its own self-contained bag. The compressor bag 100 is for the sleeping bag, and is preferably of 100% woven nylon. It includes a draw cord 103 surrounding the access opening to it, and polypropylene strapping 104 with ladder locks 105. The function of the compressor bag 100 is to compress the sleeping bag 111 into a manageable size for carrying on a pack. The sleeping bag 111 has an inner fabric shell, an open cell foam insulation interior, and another shell fabric, much as is illustrated in FIG. 15 (without layer 8). The actual construction of the top of the bag is per se shown in co-pending application Ser. No. 12,954, filed Feb. 10, 1987. This is done by rolling up the sleeping bag, opening the draw cord 103 so that the maximum opening of the compressor bag 100 is provided, slipping the compressor bag over the rolled up sleeping bag, and then pulling on the strapping 104 to tighten them as tight as possible at the ladder locks, and compress the bag 111.

The compressor bag 101 for the moisture handling pad 110 is essentially identical to bag 100 except that it is smaller, having a draw cord 106 at the opening, polypropylene strapping 107, and ladder locks (not shown). The moisture handling pad 110 is rolled up and placed into the compressor bag 101 as described above with respect to the sleeping bag.

The moisture handling pad/deicing cloth 110 is placed underneath the sleeping bag to handle moisture that migrates from the sleeping bag. Moisture will be moved away from the bottom of the sleeping bag and collect and freeze in the deicing cloth rather than in the sleeping bag, and ice thus can be readily removed from the deicing cloth. The moisture handling pad/deicing cloth preferably comprises a covering fabric such as 100% woven nylon rib stock, with insulation such as open cell polyurethane foam provided interiorly of the covering fabric. Polypropylene webbing loops 112 are provided in association with it so that the sleeping bag may be removably attached to it by passing straps 113 from the sleeping bag through the webbing loops 112 and snapping them in place with plastic fasteners 114.

The bivvy sack 102 also is an important part of the sleeping system. The bivvy sack 102 may be collapsed into its own pouch, and shown in the collapsed position in its own pouch in FIG. 1, and in the open position in FIG. 14. The bivvy sack 102 preferably is formed of VERSATECH or like fabric having good wind resistance and high moisture vapor transmission. The bivvy sack includes an opening 115 through which the sleeping bag/moisture handling pad/deicing cloth combination may be inserted, with an excess of material 116 that may function as a tent provided adjacent the opening 115, and on the opposite side of the opening 115 from the main body 117 of the bivvy sack, into which the majority of the sleeping bag/moisture handling pad/deicing cloth system is inserted. Once the sleeping bag/moisture handling pad/deicing cloth system is in the bivvy sack 102, with the snorkel hooded portion 118 of the sleeping bag 111 at the top and overlaid by the tent forming portion 116, the user can either fold the tent flap 116 down so that it is not in use, or stake it to the ground over his head. Polypropylene webbing loops 119 are provided at various positions along the tent flap 116 to allow it to be staked.

The bivvy sack functions to provide additional wind and precipitation protection for the sleeping bag and the moisture handling pad.

A vapor barrier, such as a plastic sheet, may be provided beneath the bivvy sack, on top of the ground, when the sleeping system is being utilized.

It will be seen that components of the cold weather system according to the present invention effectively cooperate to provide comfort to the wearer between about −60° F.–+40° F., and in wind conditions up to 100 miles per hour. While the invention has been herein shown and described in what is presently conceived to be the most practical and preferred embodiment thereof, it will be apparent to those of ordinary skill in the art that many modifications may be made thereof within the scope of the invention, which scope is to be accorded the broadcast interpretation of the appended claims to encompass all equivalent structures and systems.

What is claimed is:

1. A cold weather system comprising:

a shirt, including means for partially venting the shirt;

pants including means for partially venting the pants;

said shirt and pants, with cooperating head gear, hand gear, and footwear, being of a material providing cold weather protection between the temperatures of about −25° F. and +20° F.;

a parka, for cooperating with said shirt and pants for extending the effective range of comfort when worn with said shirt and pants about 25° F.; and wind protecting garments, including a wind shirt and wind pants, made of a material having high moisture transport capabilities but low air porosity, said wind garments dimensioned to fit over said shirt and pants, over said shirt, pants, and parka, said wind protecting garments lowering the effective comfort range of the other garments, when utilized therewith, about 10° F. in still air, and lowering the effective comfort range wind chill factor by about 50° F.

2. A system as recited in claim 1 wherein said shirt, and pants include an inner fabric, of synthetic material; a layer of insulating foam at least about ⅛ inch thick; a foam covering fabric having very low wind resistance, and high air permeability; and an outer shell fabric; said outer shell fabric connected to the inner fabric, foam, and foam covering fabric over only a portion thereof, and ventable to expose said insulation covering fabric to atmospheric air, or movable to prevent exposure of the insulation cover fabric to atmospheric air; and wherein said parka comprises an inner fabric of 100% synthetic material, a foam insulation layer at least ⅛ inch thick, and an outer shell fabric having low air porosity.

3. A cold weather shirt and a cold weather pair of pants, each having a thermally insulating high air porosity inner portion, and a low air porosity outer portion; and means for connecting said inner and outer portions together so that said outer portion can be moved from a first position in which it selectively covers substantially the entire inner portion to provide maximum warmth and wind resistance to a second position in which it exposes a portion of the inner portion to atmospheric air to thereby reduce the warmth and wind resistance provided by the shirt and pants.

4. Wind garments for use with other underlying garments for protection against the wind, said wind garments consisting essentially of a shirt portion and a pants portion, both said shirt portion and said pants portion being of material having an air permeability of less than 15 cubic feet/min./ft.$^2$ at 0.5 inches of water, and a moisture vapor transmission rate of at least about 1,000 grams/m.$^2$/24 hr.

5. A cold weather shirt comprising:

an inner thermal insulating, high air porosity component;

an outer shell component of low air porosity;

said inner and outer components including cooperating sleeves and body portions, the sleeves and body portion of the inner component disposed within the outer shell, and the inner and outer components connected only along a small portion of the peripheral areas thereof;

each of said inner and outer components comprising a front having openable portions; and said outer shell component being movable with respect to said inner component so that said outer shell component exposes a substantial portion of said inner component to ambient air so that the thermal insulative effect of the inner component is significantly reduced.

6. A shirt as recited in claim 5 wherein the sleeves of the inner and outer components are unconnected adjacent the wrist portions thereof, so that said sleeves of said outer component may be pushed or rolled up to expose the majority of the sleeve length of the inner component to atmospheric air; and further comprising attaching means for attaching the outer shell component tightly over the inner component at the wrist bands when desired.

7. A shirt as recited in claim 5 further comprising fastening means operatively associated with the front openable portions of said outer shell for retaining front sections of said outer component away from the front closure for said inner component so that a majority of the front of the inner component is exposed to atmospheric air.

8. A shirt as recited in claim 5 further comprising fastener means associated with said inner component for providing fastening of lapel sections of said inner component in an open position so that ambient air may pass past the lapel portions of the inner component to cool the wearer.

9. A shirt as recited in claim 5 further comprising a hood attached thereto, said hood attached to said shirt only at the back neckline portion of said shirt.

10. A pair of cold weather pants comprising an inner component having good thermal insulative properties but high air permeability, and an outer component having low air permeability, said outer component connected to said inner component, only at spaced locations so that air may selectively be allowed into a volume between significant portions of the inner and outer components; and vent means provided in said outer component for allowing air flow therethrough into the volume between said inner and outer components, said vent means closable by closure means.

11. Pants as recited in claim 10 wherein said vent means comprise a plurality of generally vertically disposed slits formed in the front of said pants, on opposite sides of the crotch portion thereof, said vents allowing—when the closures associated therewith are opened—air flow between the inner and outer components at the thigh, crotch, and buttocks portions of the pants.

12. Pants as recited in claim 11 wherein said vent slits comprise a pair of slits extending from approximately the waist area of the pants to just below the bottom of the crotch portion of the pants.

13. Pants as recited in claim 12 further comprising stitching means for attaching the outer component to the inner component along the entire peripheries thereof at a point just below the bottom terminations of the vent slits, to prevent snow, or other material, which may enter the vent slits from passing completely down the legs of the pants.

14. Pants as recited in claim 10 further comprising leg openings at the bottoms thereof, and gussets with snaps disposed thereon adjacent the bottom opening of the pants, said snaps providing for facilitating easy tightening of the pants so that the pants may be totally disposed around the shin or ankle of a wearer, and readily inserted into footwear.

15. Pants as recited in claim 10 comprising a back bib portion, with a drop seat, the drop seat held up by said attachment means including strap portions and fasteners connecting the drop seat at the side and front of the pants.

16. Pants as recited in claim 11 wherein said inner component comprises an inner fabric lining of 100% synthetic material, a layer of insulating foam at least about $\frac{1}{8}$ inch thick, and an outer very high air porosity insulation covering fabric, said outer fabric being disposed over said insulation on at least portions thereof which can be exposed to the ambient air by opening of said vents; and wherein said outer component consists of a shell fabric of tightly woven 100% synthetic yarn.

17. A cold weather parka comprising an inner fabric of 100% synthetic material, an interior layer of foam at least about $\frac{1}{8}$ inch thick, and an outer shell fabric of 100% synthetic material, said parka having a moisture vapor transmission rate of at least 500 grams/m.$^2$/24 hr.; and a windskirt provided on the interior of the parka, the windskirt including fasteners for fastening two end portions of the windskirt together at the front of the parka, and including means at the bottom of the windskirt for holding the windskirt in contact with the legs of the wearer.

18. A parka as recited in claim 17 further comprising strap means associated with the parka and deployable adjacent the windskirt, and adapted to cooperate with a wind shirt of low air porosity material to provide an emergency bivac sleeping bag.

19. A parka as recited in claim 18 in combination with a wind shirt of low air porosity material, the wind shirt having open portions thereof closed so as to essentially form a bag with an open end, and strap means associated with the open end having fasteners for cooperating with fasteners on the strap means associated with the parka to hold the parka and wind shirt together.

* * * * *

UNITED STATES PATENT AND TRADEMARK OFFICE

CERTIFICATE OF CORRECTION

PATENT NO. : 4,843,647

DATED : July 4, 1989

INVENTOR(S) : PHILLIPS, Sr. et al

It is certified that error appears in the above-identified patent and that said Letters Patent is hereby corrected as shown below:

In the Abstract, on the title page, line 16, the word "bivac" should read --bivouac--.

Figs 7-15 of the drawings should be added as shown on the attached sheets.

In column 1, line 19, after the word "The" delete the comma.

In column 3, line 2, change "for" to --from--.

In column 4, line 29, change "knit rib" to --rib knit--.

In column 7, line 45, delete "the".

In column 8, line 48, change "bivac" to --bivouac--.

In column 9, line 5, change "8" to --18--.

In column 9, lines 5 and 6, change "the bag is per se shown" to --the bag per se is shown--.

UNITED STATES PATENT AND TRADEMARK OFFICE

CERTIFICATE OF CORRECTION

PATENT NO. : 4,843,647

DATED : July 4, 1989

INVENTOR(S) : Phillips, Sr. et al

It is certified that error appears in the above-identified patent and that said Letters Patent is hereby corrected as shown below:

In column 11, lines 57 and 58, change "allowin-g" to --allowing--.

In column 11, line 58, and column 12, line 1, change "opene-d" to --opened--.

Signed and Sealed this

Eighteenth Day of December, 1990

*Attest:*

HARRY F. MANBECK, JR.

*Attesting Officer*

*Commissioner of Patents and Trademarks*

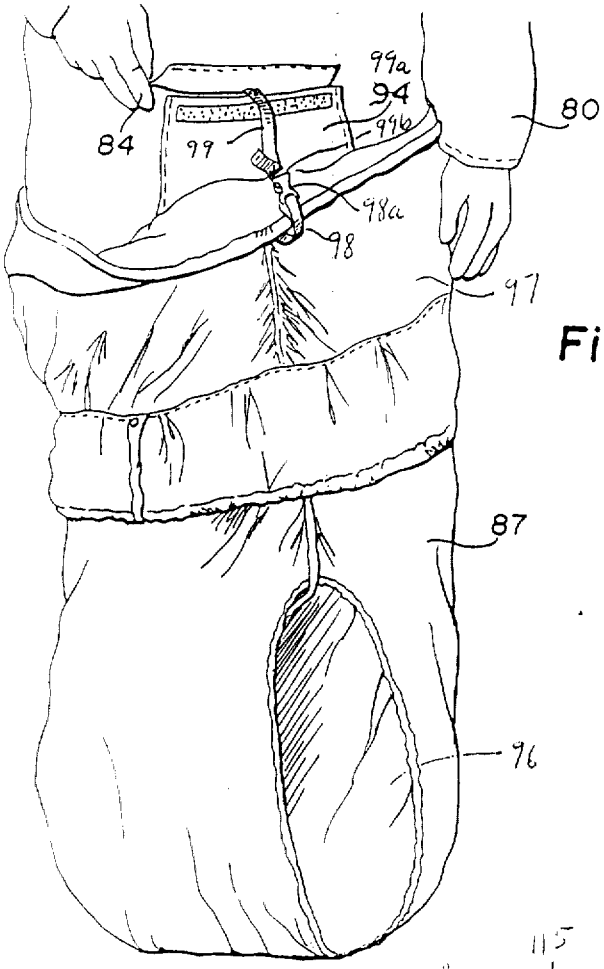
Fig. 13
Fig. 14
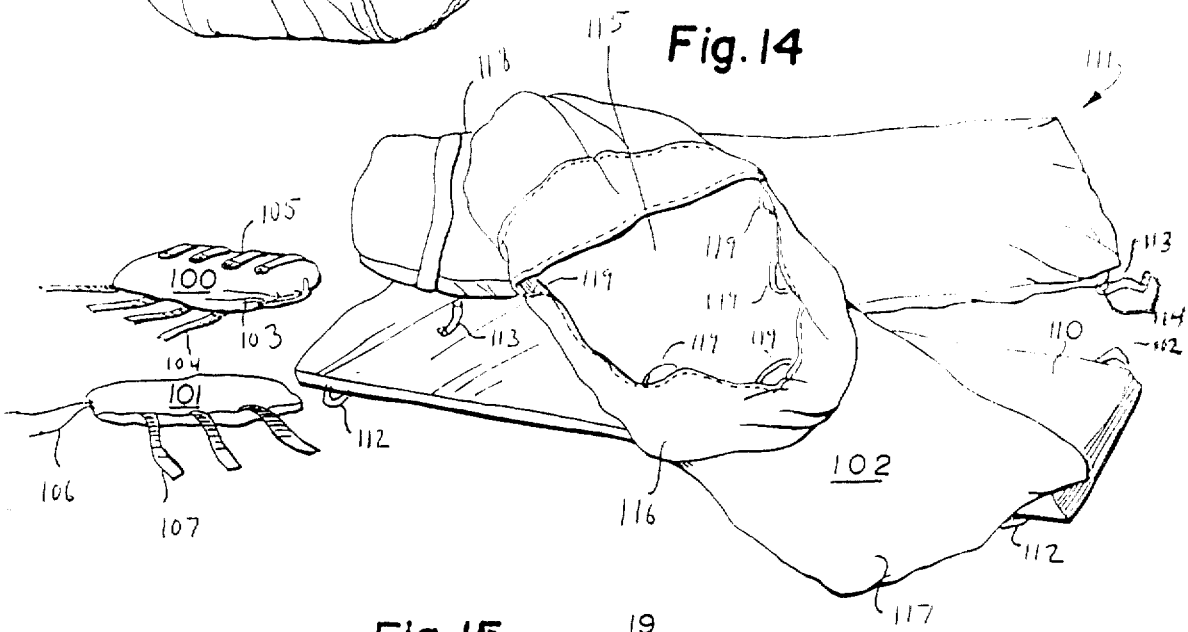
Fig. 15
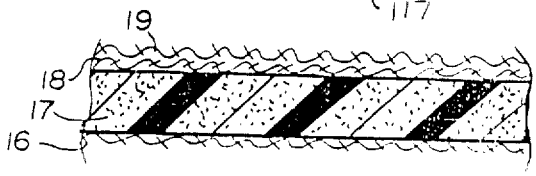

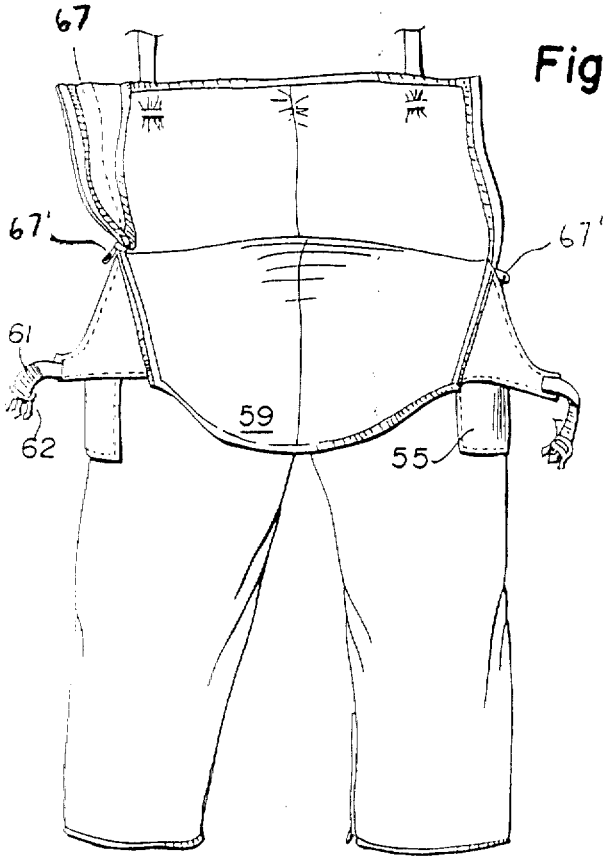
Fig. 10
Fig. 11
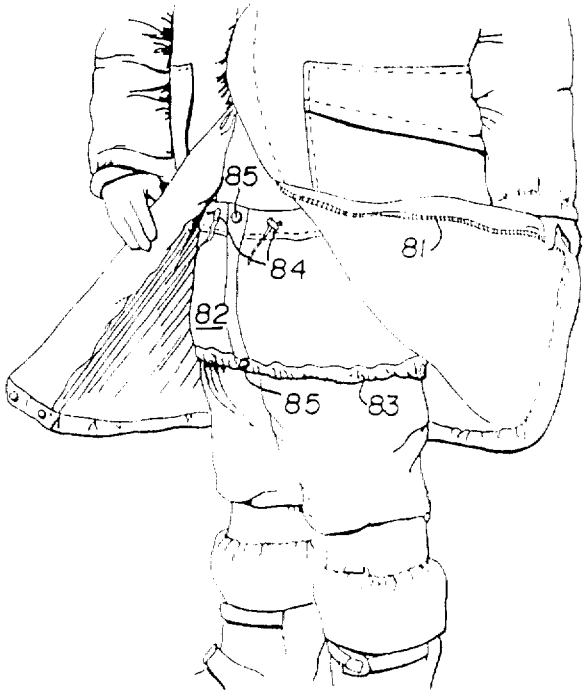
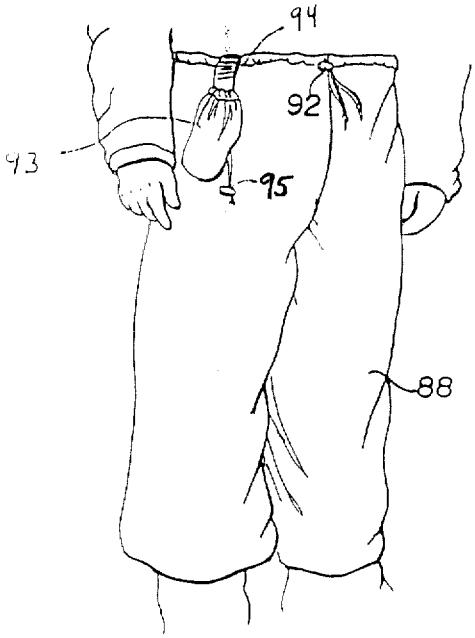
Fig. 12